US006195526B1

(12) United States Patent
Lee et al.

(10) Patent No.: US 6,195,526 B1
(45) Date of Patent: Feb. 27, 2001

(54) FIXATION ROLLER FOR LIQUID ELECTROPHOTOGRAPHIC PRINTER AND TRANSFERRING APPARATUS ADOPTING THE SAME

(75) Inventors: Jin-soo Lee, Seoul; Chang-soo Rhee, Suwon, both of (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/450,733

(22) Filed: Nov. 30, 1999

(30) Foreign Application Priority Data

Dec. 18, 1998 (KR) ..... 98-56200

(51) Int. Cl.[7] ..... G03G 15/20

(52) U.S. Cl. ..... 399/333; 219/216; 399/307; 399/325; 492/56

(58) Field of Search ..... 399/330, 333, 399/324, 325, 307; 219/216; 118/60, 246, 258; 524/492; 428/36.8, 447; 492/56

(56) References Cited

U.S. PATENT DOCUMENTS 4,231,653 * 11/1980 Nagahara et al. ..... 399/325
4,976,877 * 12/1990 Agostinelli et al. ..... 219/216
5,123,151 * 6/1992 Uehara et al. ..... 492/56
5,650,253 * 7/1997 Baker et al. ..... 399/307 X
5,966,578 * 10/1999 Soutome et al. ..... 399/333
6,009,300 * 12/1999 Kagawa et al. ..... 399/333

FOREIGN PATENT DOCUMENTS 62-044754 * 2/1987 (JP) .
1-031183 * 2/1989 (JP) .

* cited by examiner

*Primary Examiner*—Sophia S. Chen
(74) *Attorney, Agent, or Firm*—Sughrue, Minn, Zinn, Macpeak & Seas, PLLC

(57) ABSTRACT

A fixation roller for a liquid electrophotographic printer rotates in contact with a transfer roller transferring an image developed on a photoreceptor web to a sheet of paper. The fixation roller includes a body made of metal, an elastic rubber layer formed on the outer circumferential surface of the body, and silicon oil included in the rubber layer to come out to the surface of the rubber layer at a high temperature during printing, thus encompassing the surface of the rubber layer.

2 Claims, 5 Drawing Sheets

FIXATION ROLLER FOR LIQUID ELECTROPHOTOGRAPHIC PRINTER AND TRANSFERRING APPARATUS ADOPTING THE SAME

BACKGROUND OF THE INVENTION

1. Field of the Invention

The present invention relates to a fixation roller for a liquid electrophotographic printer contacting a transfer roller which transfers an image to a sheet of paper and a transferring apparatus adopting the same.

2. Description of the Related Art

In general, a liquid electrophotographic printer such as a laser printer or a copier uses developer which is a mixture of powdered toner and liquid carrier. Referring to FIG. 1, a conventional liquid electrophotographic printer includes a photoreceptor web 10 circulating by being supported by a plurality of guide rollers 11, one or more developing unit 14 and a transferring unit 17. The transferring unit 17 includes a transfer roller 15 and a fixation roller 16.

The photoreceptor web 10 is charged by a charger 12 to a predetermined electric potential. A laser scanning unit 13 installed at the developing unit 14 emits a beam onto the surface of the photoreceptor web 10. Accordingly, the electric potential of the photoreceptor web 10 changes and an electrostatic latent image is formed thereon. The developing unit 14 supplies developer to the surface of the photoreceptor web 10 to develop the electrostatic latent image and residual developer is collected. As the photoreceptor web 10 circulates, the developed image formed on the surface of the photoreceptor web 10 is transferred to the transfer roller 15 due to a difference in surface energy and then printed on a sheet of paper P passing between the transfer roller 15 and the fixation roller 16.

Here, the fixation roller 16 is driven while pressing the transferring roller 15 with a predetermined pressure, and a rubber layer is provided around the outer circumference thereof.

However, when the conventional liquid electrophotographic printer is used for a long time, foreign materials such as remaining toner particles adhering to the surface of the transfer roller 15 are moved to the fixation roller 16 and then accumulated thereon. The contamination of the fixation roller 16 increases the surface energy of the fixation roller 16. Thus, the paper P passing between the transfer roller 15 and the fixation roller 16 is bent or folded toward the fixation roller 16.

SUMMARY OF THE INVENTION

To solve the above problem, it is an objective of the present invention to provide a fixation roller for a liquid electrophotographic printer having an improved structure so that the fixation roller is prevented from being contaminated, and a transferring apparatus adopting the same.

Accordingly, to achieve the above objective, there is provided a fixation roller for a liquid electrophotographic printer rotating in contact with a transfer roller transferring an image developed on a photoreceptor web to a sheet of paper, in which the fixation roller comprises a body made of metal, an elastic rubber layer formed on the outer circumferential surface of the body, and silicon oil included in the rubber layer to come out to the surface of the rubber layer at a high temperature during printing and encompass the surface of the rubber layer.

It is preferable in the present invention that the silicon oil is made by mixing with rubber which is used as a material for the rubber layer.

Also, it is preferable in the present invention that the amount of the silicon oil added is about 2–3 wt % with respect to rubber.

To achieve another aspect of the above objective, there is provided a transferring apparatus including a transfer roller for transferring an image developed on a photoreceptor web to a sheet of paper and a fixation roller rotating in contact with the transfer roller, in which the fixation roller comprises a body made of metal, an elastic rubber layer formed on the outer circumferential surface of the body, and a silicon oil layer formed by coating the outer circumferential surface of the rubber layer to a predetermined thickness.

It is preferable in the present invention that the transferring apparatus further comprises a means for supplying silicon oil to the rubber layer.

Also, it is preferable in the present invention that the means for supplying silicon oil comprises an oil supply roller installed to be rotated in contact with the rubber layer of the fixation roller and a tank for supplying silicon oil to the oil supply roller.

Also, it is preferable in the present invention that the oil supply roller is made of stainless steel or urethane.

BRIEF DESCRIPTION OF THE DRAWINGS

The above objective and advantages of the present invention will become more apparent by describing in detail a preferred embodiment thereof with reference to the attached drawings' in which.

DETAILED DESCRIPTION OF THE INVENTION

Figure 1:
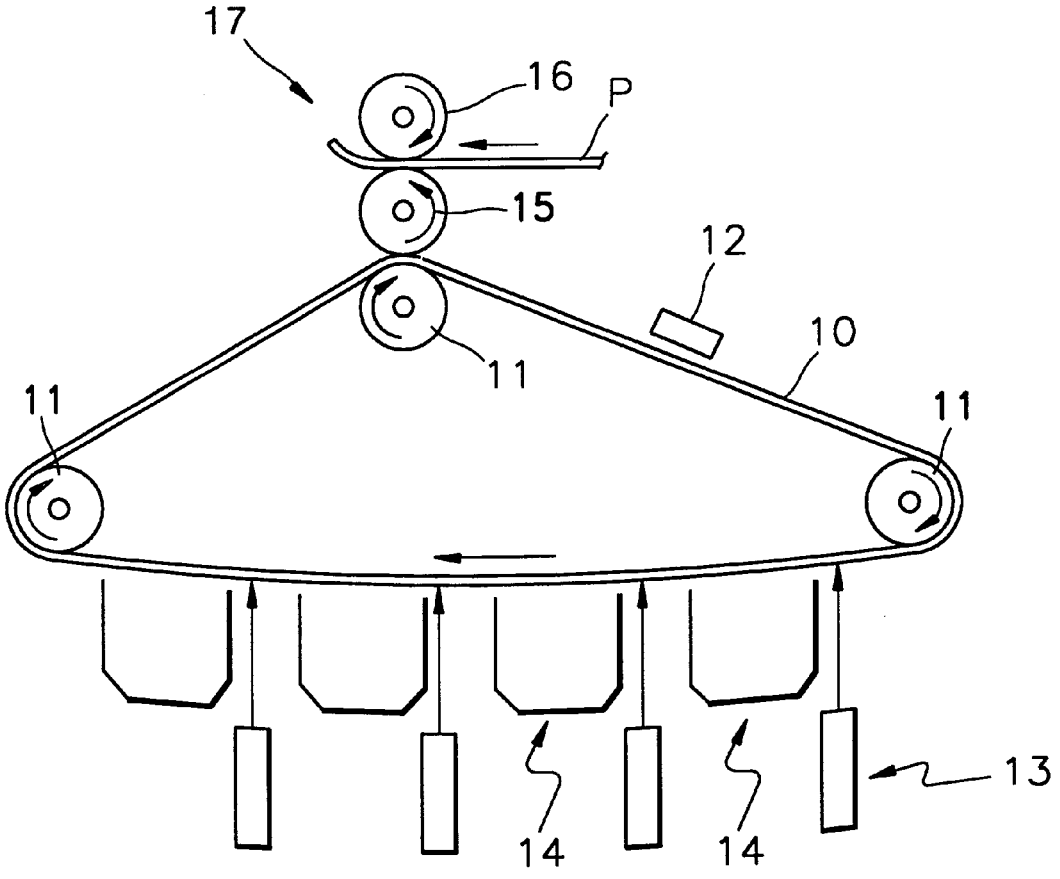
FIG. 1 (PRIOR ART)
FIG. 1 is a view showing the structure of a conventional liquid electrophotographic printer.
Figure 2:
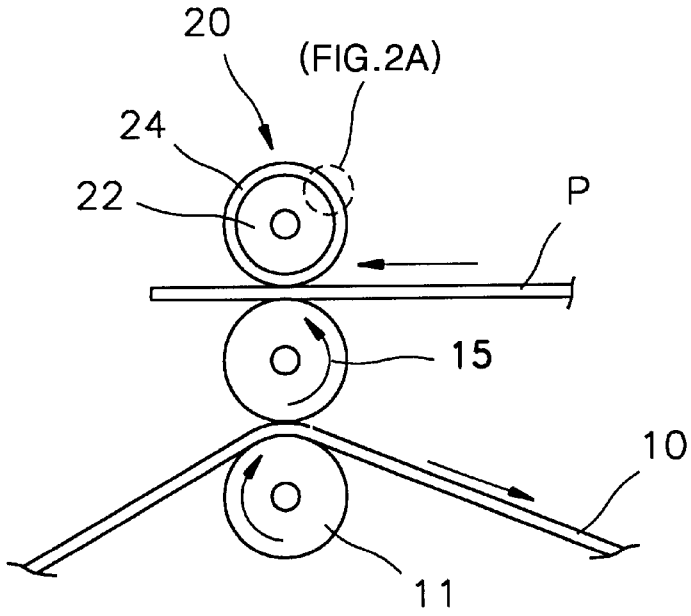
FIGS. 2 and 2A are views showing a part of a liquid electrophotographic printer adopting a fixation roller according to a preferred embodiment of the present invention.
Figure 2A:
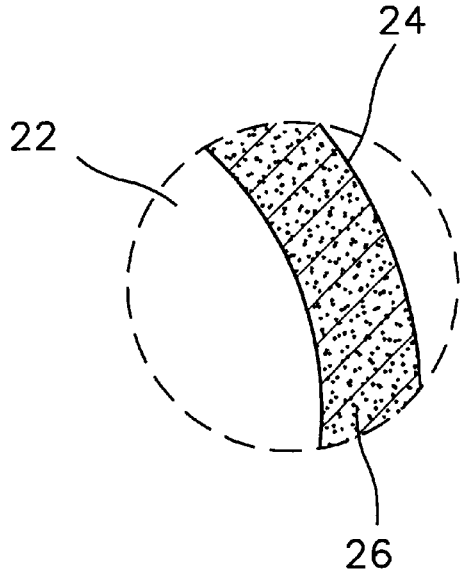

Referring to FIG. 2, the photoreceptor web 10 circulates in one direction by the guide roller 11 and the transfer roller 15 rotates in contact with the photoreceptor web 10. The transfer roller 15 contacts a fixation roller 20 according to the characteristic feature of the present invention, having the paper P interposed therebetween. In a print mode, the fixation roller 20 presses the transfer roller 15 by being driven by a pressing means (not shown) such that the image developed on the surface of the photoreceptor web 10 can be transferred to the paper P via the transfer roller 15. Here, the same reference numerals indicates the same elements in FIGS. 1 and 2.

The fixation roller 20 includes a body 22 formed of metal and a rubber layer 24 mixed with silicon oil 26 provided to encompass the outer circumference of the body 22. The rubber layer 24 is provided to elastically press the transfer roller 15.

Figure 3:
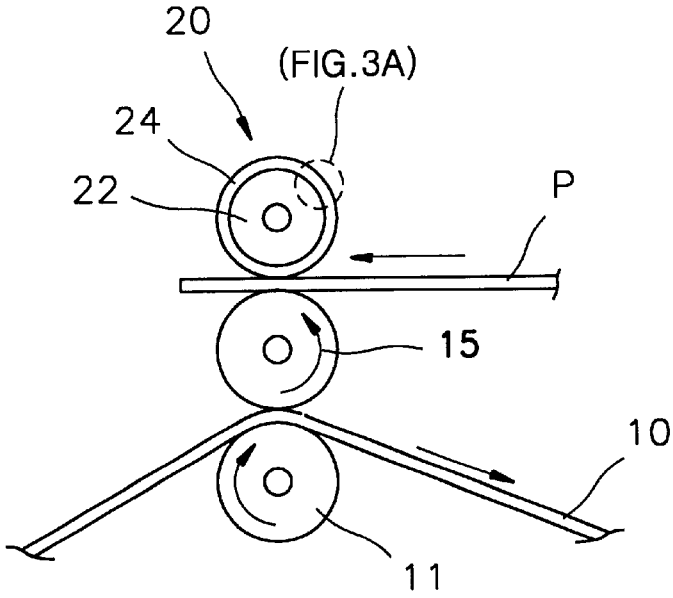
FIGS. 3 and 3A are views for explaining the operation of the fixation roller shown in FIG. 2.
Figure 3A:
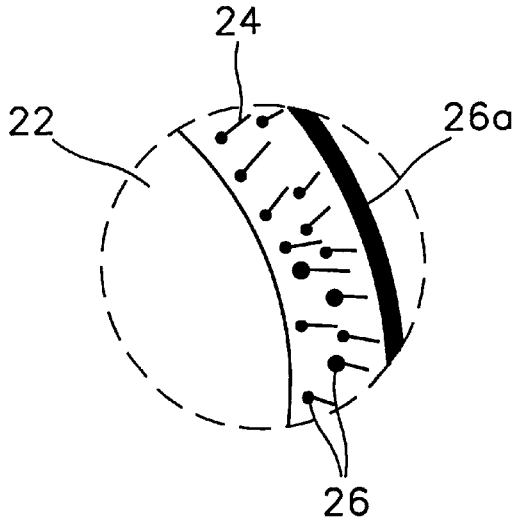

The silicon oil 26 included in the rubber layer 24 encompasses the outer circumference of the rubber layer 24 to prevent contamination by toner particles in the print mode. The silicon oil 26 comes out to the surface as shown in FIG. 3 when the rubber layer 24 of the fixation roller 20 is heated in the print mode. Thus, in the print mode, the silicon oil 26 encompasses the surface of the rubber layer 24 to form a silicon oil layer 26*a* so that foreign materials such as toner particles are prevented from adhering thereto.

The silicon oil 26 is added in the process of rubber mixing for forming the rubber layer 24. In particular, the silicon oil 26 is added as a plasticizer prior to adding sulfur to give elasticity to the rubber layer 24. Preferably, the amount of the silicon oil 26 added is about 2–3 wt % with respect to the amount of rubber to cover the surface of the rubber layer 24 to have a thin thickness.

Figure 4:
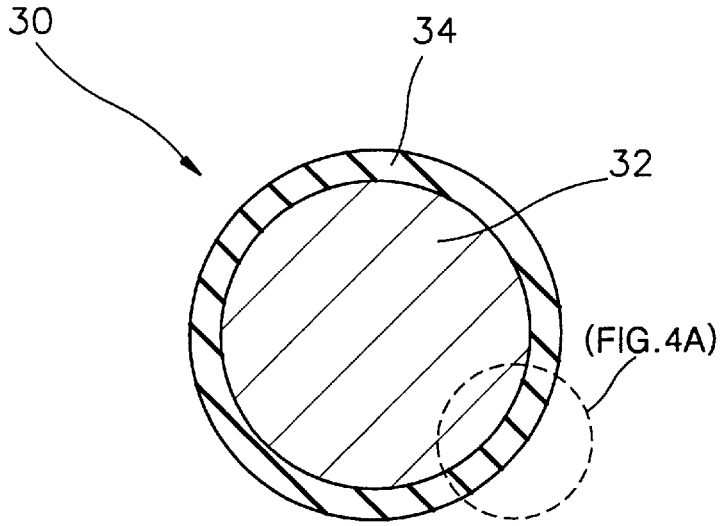
FIG. 4 is a sectional view and FIG. 4A is an enlarged view showing a fixation roller for a liquid electrophotographic printer according to another preferred embodiment of the present invention.
Figure 4A:
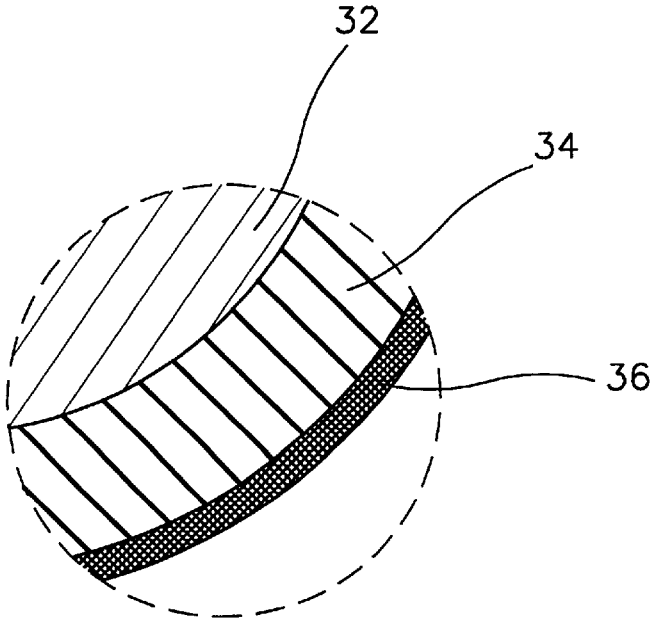

According to another preferred embodiment of the present invention shown in FIG. 4, a fixation roller 30 includes a body 32 formed of metal, a rubber layer 34 provided at the outer circumference of the body 32, and a silicon oil layer 36 encompassing the outer circumference of the rubber layer 34. The silicon oil layer 36 is to prevent the surface of the rubber layer 34 from being contaminated by toner particles adhering thereto, and can be provided by coating silicon oil on the surface of the rubber layer 34 by a well-known method of knife coating or dipping coating.

Alternatively, the silicon oil layer 36 can be formed by spraying silicon oil on the surface of the rubber layer 24 and drying the sprayed surface.

Figure 5:
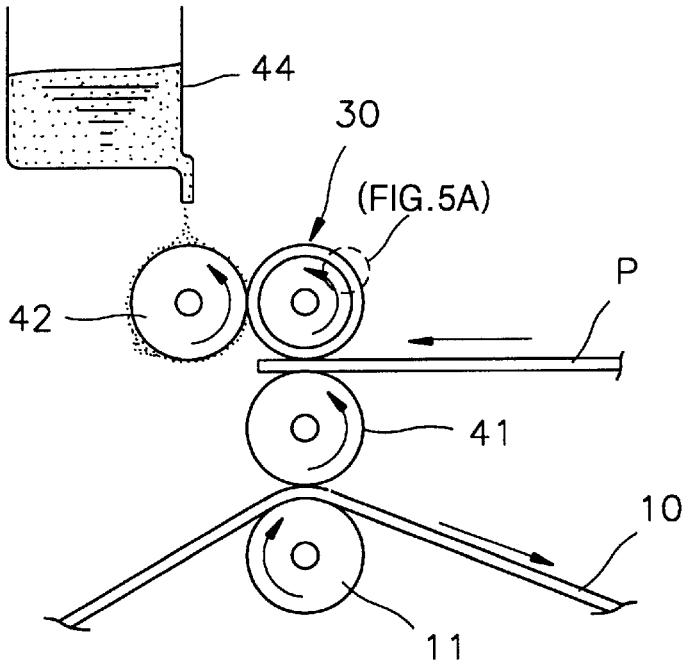
FIGS. 5 and 5A are views showing the structure of a transferring apparatus for the liquid electrophotographic printer adopting the fixation roller according to another preferred embodiment of the present invention.
Figure 5A:
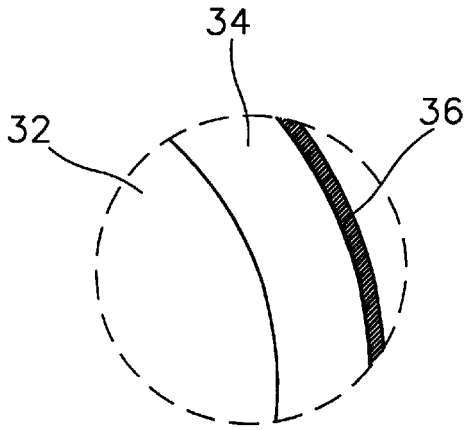

FIG. 5 shows a part of the structure of a transferring apparatus for a liquid electrophotographic printer adopting the fixation roller according to the present invention. As shown in drawing, the transferring apparatus includes a transfer roller 41 contacting the photoreceptor web 10, a fixation roller 30 rotating in contact with the transfer roller 41 and having a silicon oil layer 36 formed on the outer circumference thereof, and a supply means for supplying silicon oil to the silicon oil layer 36 in the print mode.

The silicon oil supply means is for forming the silicon oil layer 36 or supplying silicon oil to the already-formed silicon oil layer 36. The supply means or supplies includes an oil supply roller 42 rotating in contact with the fixation roller 30 and a tank 44 for supplying silicon oil to the oil supply roller 42.

The oil supply roller 42 rotating in contact with the rubber layer 34 of the fixation roller 30 forms the silicon oil layer 36 with silicon oil supplied from the tank 44. Preferably, the oil supply roller 42 is made of urethane or stainless steel material which does not absorb, or absorbs only a little, silicon oil. Also, the tank 44 is disposed above the oil supply roller 42 so that it can supply silicon oil due to the gravity.

In the transferring apparatus having the above structure, when the silicon oil layer 36 loses silicon oil as it contacts the paper P, the silicon oil can be continuously supplemented from the tank 44.

As described above, according to the present invention, as the fixation roller is provided with a silicon oil layer, contamination of the surface thereof due to toner particles can be prevented. Thus, an increase of surface energy of the fixation roller is restricted so that the paper is prevented from being bent or folded, improving reliability of the printer.

What is claimed is:

1. A fixation roller, for a liquid electrophotographic printer, rotating in contact with a transfer roller transferring an image developed on a photoreceptor web to a sheet of paper, the fixation roller comprising:

a body made of metal;

an elastic rubber layer formed on an outer circumferential surface of the body to have a predetermined thickness; and silicon oil included in the rubber layer and operative to come out to a surface of the rubber layer at a high temperature during printing and which encompasses the surface of the rubber layer, wherein the silicon oil is made by mixing with a rubber which is used as a material for the rubber layer.

2. The fixation roller as claimed in claim 1, wherein the amount of the silicon oil added is about 2–3 wt % with respect to the rubber.

* * * * *

UNITED STATES PATENT AND TRADEMARK OFFICE

CERTIFICATE OF CORRECTION

PATENT NO. : 6,195,526 B1
DATED : February 27, 2001
INVENTOR(S) : Jin-soo Lee and Chang-soo Rhee It is certified that error appears in the above-identified patent and that said Letters Patent is hereby corrected as shown below:

Title page,

References Cited

Item [56], FOREIGN PATENT DOCUMENTS, insert the following --

| | | |
|---|---|---|
| 54-5441 | 01/1979 | (JP) |
| 4-507303 | 12/1992 | (JP) |
| 7-502601 | 03/1995 | (JP) |
| 61-27155 | 02/1986 | (JP) |
| 10-326052 | 12/1998 | (JP) |
| 59-73763 | 05/1984 | (JP) |

Signed and Sealed this

Twentieth Day of November, 2001

*Attest:*

Nicholas P. Godici

*Attesting Officer*

NICHOLAS P. GODICI
*Acting Director of the United States Patent and Trademark Office*